US009253840B2

(12) United States Patent
Fuller et al.

(10) Patent No.: US 9,253,840 B2
(45) Date of Patent: Feb. 2, 2016

(54) LIGHTING DISPLAY

(71) Applicants: Mark Fuller, Sun Valley, CA (US); Jim Doyle, Sun Valley, CA (US); Don Lariviere, Sun Valley, CA (US); Antonio Layon, Sun Valley, CA (US); Scott Winslow, Sun Valley, CA (US); Boris Karpichev, Sun Valley, CA (US)

(72) Inventors: Mark Fuller, Sun Valley, CA (US); Jim Doyle, Sun Valley, CA (US); Don Lariviere, Sun Valley, CA (US); Antonio Layon, Sun Valley, CA (US); Scott Winslow, Sun Valley, CA (US); Boris Karpichev, Sun Valley, CA (US)

(73) Assignee: WET Design, Sun Valley, CA (US)

( * ) Notice: Subject to any disclaimer, the term of this patent is extended or adjusted under 35 U.S.C. 154(b) by 218 days.

(21) Appl. No.: 14/108,059

(22) Filed: Dec. 16, 2013

(65) Prior Publication Data

US 2014/0167627 A1 Jun. 19, 2014

Related U.S. Application Data

(60) Provisional application No. 61/737,811, filed on Dec. 16, 2012.

(51) Int. Cl.

| | |
|---|---|
| ***H05B 37/00*** | (2006.01) |
| ***H05B 39/00*** | (2006.01) |
| ***H05B 33/08*** | (2006.01) |
| ***F21S 4/00*** | (2006.01) |
| *H05B 37/02* | (2006.01) |
| *F21S 2/00* | (2006.01) |
| *F21S 10/06* | (2006.01) |
| *F21V 23/04* | (2006.01) |
| *F21W 131/401* | (2006.01) |
| *F21Y 101/02* | (2006.01) |

(52) U.S. Cl.

CPC ..... *H05B 33/0842* (2013.01); *F21S 4/001* (2013.01); *H05B 33/0803* (2013.01); *F21S 2/00* (2013.01); *F21S 10/06* (2013.01); *F21V 23/0407* (2013.01); *F21W 2131/401* (2013.01); *F21Y 2101/02* (2013.01); *H05B 37/029* (2013.01)

(58) Field of Classification Search

USPC ..... 315/160, 161

See application file for complete search history.

(56) References Cited

U.S. PATENT DOCUMENTS

2002/0097574 A1* 7/2002 Wu ..... F21S 4/001 362/185
2005/0174065 A1* 8/2005 Janning ..... H05B 33/0803 315/185 S (Continued)

FOREIGN PATENT DOCUMENTS

JP 07-099004 A 4/1995
KR 10-2012-0076887 A 7/2012

OTHER PUBLICATIONS

PCT, International Search Report and Written Opinion, International Application No. PCT/US2013/075490, Mar. 27, 2014, 7 pages.

*Primary Examiner* — Adam Houston
(74) *Attorney, Agent, or Firm* — Maceiko IP

(57) ABSTRACT

A display where lights may be programmed to randomly flash is described. The randomness may be changed by changing the mode of flashing. The lights may extend along strings that are powered by a power supply that may itself be plugged into a socket that had previously served as a light socket. The display may be added to existing displays to enhance existing visual effects. The display may be submerged and the lights may remain upright because of their buoyancy.

17 Claims, 11 Drawing Sheets

(56) References Cited

U.S. PATENT DOCUMENTS

2006/0250805 A1 11/2006 Cheng
2011/0074300 A1* 3/2011 Hsu ..... F21S 4/001 315/185 S
2014/0334648 A1* 11/2014 Wang ..... H05B 37/0272 381/150
2014/0335910 A1* 11/2014 Wang ..... H05B 37/0272 455/550.1
2015/0251402 A1* 9/2015 Cok ..... B32B 37/24 156/280

* cited by examiner

LIGHTING DISPLAY

CROSS REFERENCE TO RELATED APPLICATION

The application claims the benefit of U.S. Provisional Application No. 61/737,811, filed Dec. 16, 2012, the contents of which are incorporated herein by reference.

FIELD OF THE INVENTION

The present invention relates generally to displays involving water and lighting, including displays involving a number of lights that may be submerged, that may receive power from existing lighting fixtures and/or that may be programmed to randomly flash.

BACKGROUND OF THE INVENTION

There are lighting displays that currently exist with flashing lights. However, the sequence in which the lights are flashed in these displays may be predictable and/or constant. This limits the visual effects and dramatic value provided by the display. Accordingly, there is a need for lighting displays in which the lights may randomly flash.

This is especially so where a large number of lights make up the display. That is, the difficulty in attempting to randomize the flashing of a large number of lights would be very difficult. Accordingly, there is a need for a manner in which to randomize the flashing of lights, including a large number of lights.

There are also lighting and water displays that have existed for some time. While these displays may continue to provide attractive visual effects, it may be that these displays could use an enhancement. Accordingly, there is a need for a display that may be added to existing displays to enhance existing visual effects.

SUMMARY OF THE INVENTION

An aspect of the current invention regards a unique lighting display wherein lights may be submerged in water. The lights may be positioned over a large area, though the area of the display may vary. The lights are designed to be buoyant so that preferably they remain upright.

In another aspect of the invention, the lights may flash randomly. To this end, the flashing of the lights may be controlled by a software program which provides for random flashing. The program may provide different levels of randomness according to different modes. Randomness may also be provided by strings of lights receiving power from a power source.

In another aspect of the invention, the lights may be positioned along cables that fan out over the display area. These strings of light may be plugged into sockets that had previously housed a single light.

DETAILED DESCRIPTION OF THE PREFERRED EMBODIMENTS

Figure 1:
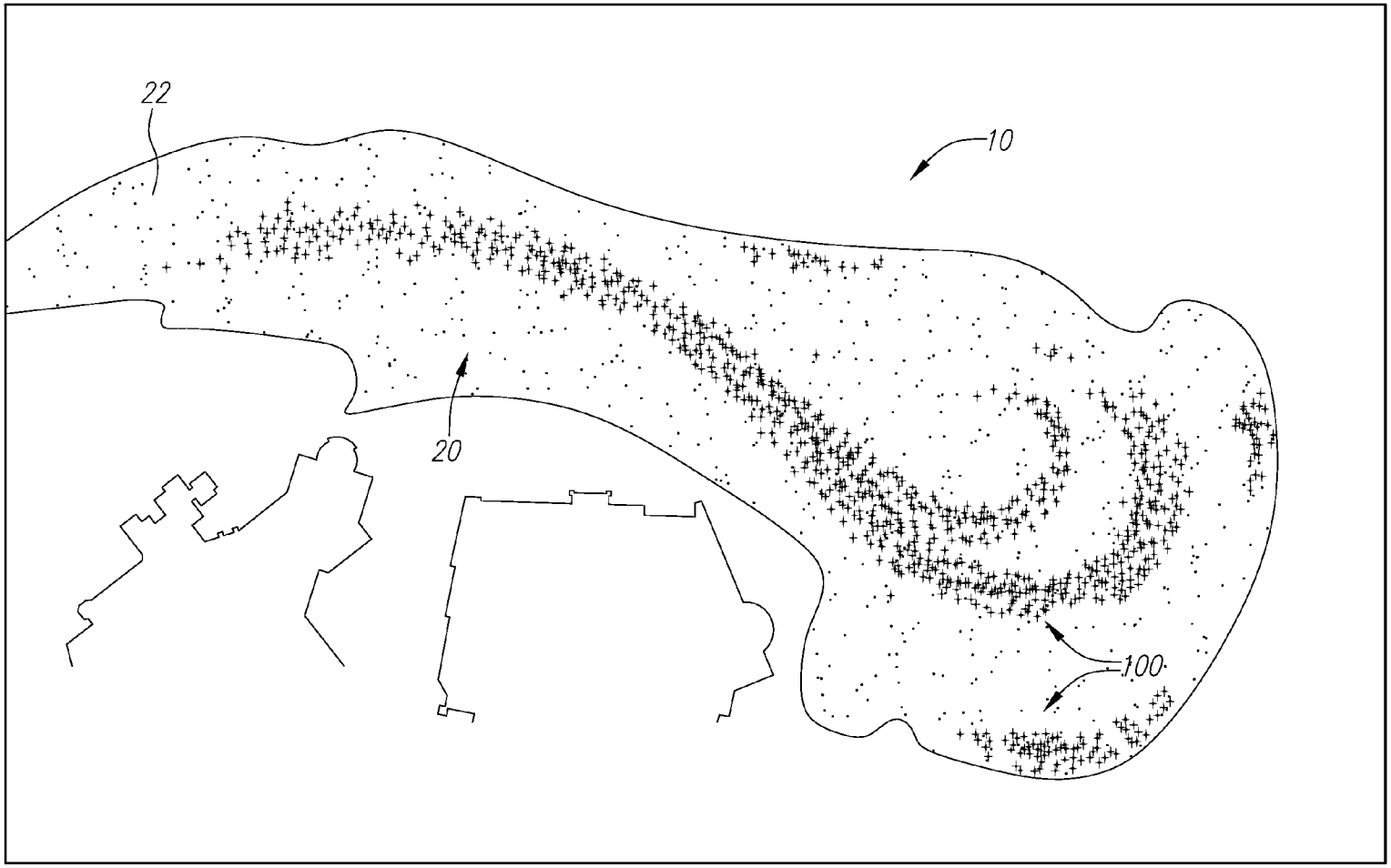
FIG. 1 is a top view of a display with lights submerged in a pool.

The display 10 of the current invention is now described with reference to the figures. Where the same or similar components appear in more than one figure, they are identified by the same reference numeral.

Figure 2:
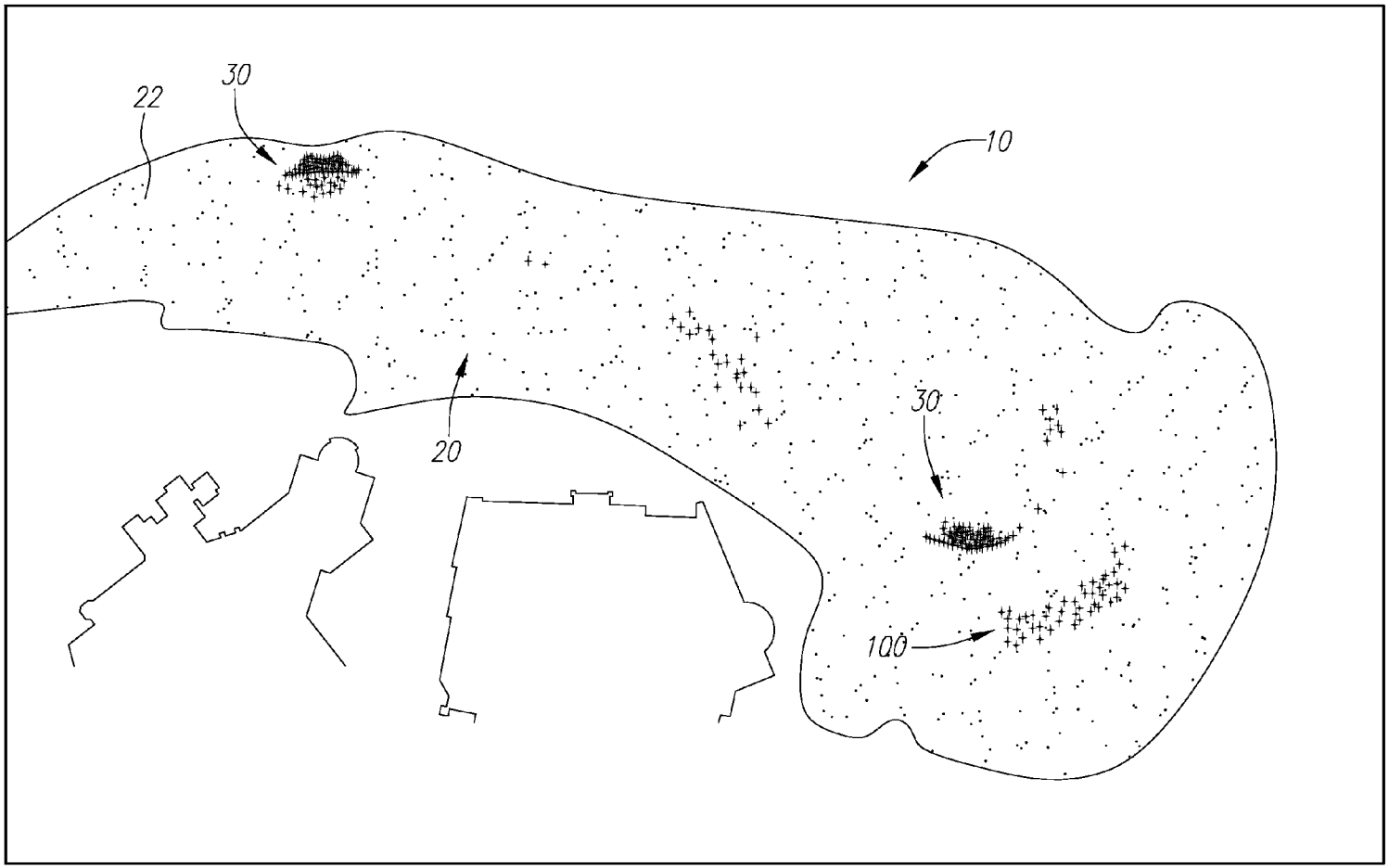
FIG. 2 is a top view of a display with lights submerged in a pool.
Figure 3:
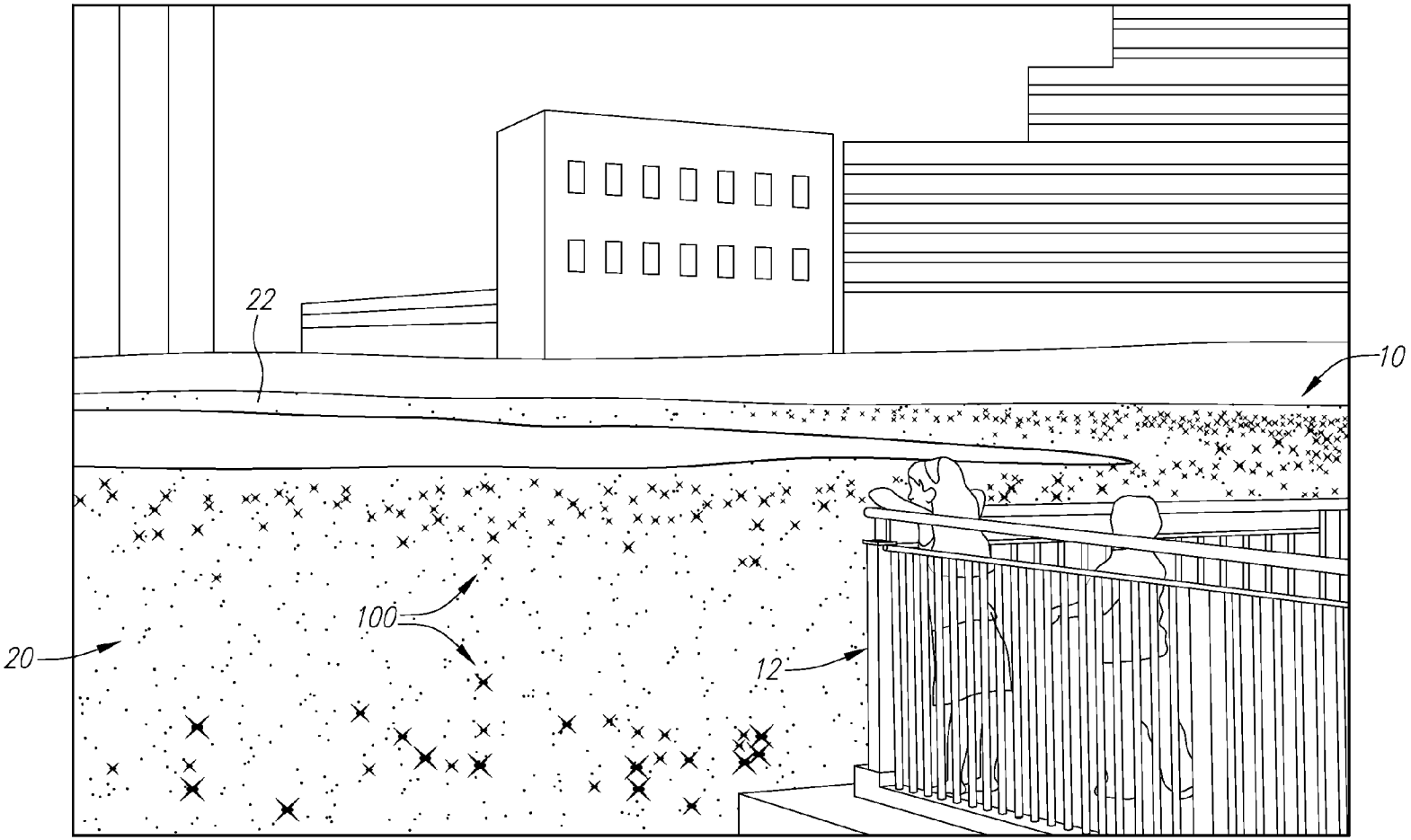
FIG. 3 is a perspective view of a display with lights submerged in a pool.

The overall display 10 is generally described with reference to FIGS. 1-3. As shown, display 10 may generally comprise a number of lights installed in a pool 20, or lake or other arrangement suitable to hold or otherwise enclose water 22 or some other liquid. The size of pool 20 and its location may vary. For example, as shown in FIGS. 1-3, pool 20 may comprise several acres and may reside amongst several hotels and/or other large buildings in a metropolitan area. Alternatively, pool 20 may be smaller and/or located in other types of areas such as theme parks or in residential areas.

Display 10 may generally contain some number of lights 100 that may flash or otherwise be turned on and off in a random fashion. The number of lights may extend into the thousands. FIGS. 1 and 2 show different lights 100 turned on at different times to provide an example of how the lights may be randomly flashed. As discussed in more detail later, lights 100 may be submerged in water 22 to provide a dramatic visual effect.

For example, lights 100 may provide the appearance of twinkling stars in the nighttime sky. This effect may be created by the randomness of the flashing of lights 100, as well as the shimmering effect provided by the water in which they may be submerged and the refraction of the flashing light as it travels through the water. Other visual effects may also be provided such as different sections of lights in the pool 20 being turned on or off.

Display 10 may also include different effects 30 such shooting fountains as shown in FIG. 2, other lighting or other effects. These other effects 30 may be used in connection with lighting 100 to provide additional overall visual effects. Display 10 of the current invention may be used by itself or in combination with these other effects. Lighting 100 of display 10 may be added to existing displays to enhance the visual effects provided thereby. As shown in FIG. 3, platforms 12 or other viewing areas may be located near display 10.

Lighting system 100 is now further described with reference to FIG. 4, which is a top view of display 10 in pool 20. As shown, lighting 100 may generally include a number of outlets 120 from which strings 140 may extend. Strings 140 may each include a number of lights 180 (as later discussed with reference to FIGS. 5A, 5B, 6 and 8). In a preferred embodiment, lights 180 are LEDs but other types of light sources may be used.

Figure 4:
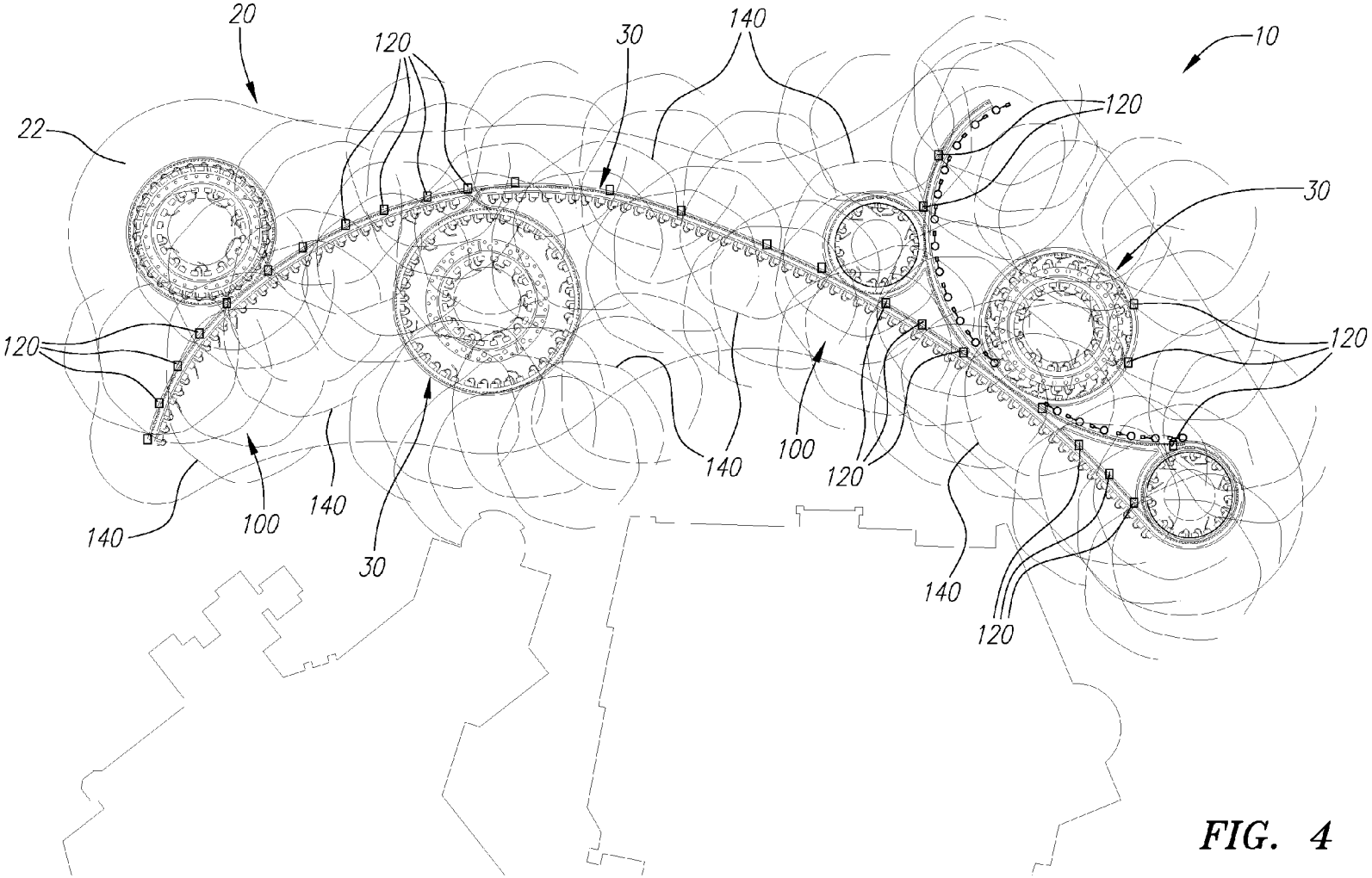
FIG. 4 is a top view of a display showing the positioning of lighting equipment.

The heavier lines shown in FIG. 4 may represent existing equipment 30 such as water jets and/or other lighting fixtures. In one embodiment of the current invention, display 10 may be added to an existing display in which equipment 30 already resides. This may allow an existing display to provide enhanced visual effects without having to completely create a new display from scratch.

Outlets 120 may comprise part of the existing equipment 30 or may be added thereto. In any event, outlets 120 may provide electrical power to strings 140 and ultimately lights 180 as described below. The number of outlets 120 may vary depending on the size of display 10, how many lights 180 are desired to be powered and other factors. The location of outlets 120 may also vary, but may generally be located about display 10 so as to provide power where desired. For example, if there are clusters of a number of lights 180 in certain areas of display 10 more so than in other areas, more outlets 120 may be located in that area. The number of outlets 120 and their location in FIG. 4 is only one example and the invention contemplates other numbers and locations.

In one embodiment, outlets 120 may have at one time been the power source for existing or other lights, but in the current invention, some or all of outlets 120 may be transformed to function as the power source for lights 180. This may occur by removing the light originally plugged into outlet 120 and replacing it with power supply 160 which in turn powers lights 180.

The structure of lighting 100 is now further described with reference to FIGS. 5A, 5B and 6-8. In general, outlet 120 may provide power to power supply 160, which may be plugged into outlet 120. Power supply 160 may be attached to string 140 which may then provide power to lights 180. In one embodiment, there may be twenty lights attached to string 140, but this number may vary.

In a preferred embodiment, outlet 120 may be powered via a cable 122 that extends from a remote power source. Outlet 120 may provide 110 v AC power to the power supply 160 plugged into it. Power supply 160 may then in turn provide 12 v DC power to strings 140 and lights 180 along that string. More specifically, cable 142 may extend from power supply 160 to T-junction 144. From there, cable 144 may extend, and provide power, to light 180. Cable 148 may extend distally from T-junction 144 and provide power to another T-junction (not shown) and light 180. This may repeat for as many lights 180 are desired to be attached to that string 140.

As discussed in more detail later, it is preferred that lights 180 include housing 182 and dome 184 that encapsulates components and protects them from the water 22. It is preferred that the air trapped in dome 184 provide buoyancy to light 180. Housing 182 may also be formed of plastic or other lightweight material that contributes to its buoyancy. This buoyancy, along with the weight of the cables 142, 148 and T-junction 144, preferably provide that lights 180 generally remain upright. To this end, this weight may allow the cables comprising strings 140 to simply rest on the bottom of pool 20. Alternatively, strings 140 may be attached to the pool bottom.

Figure 5B:
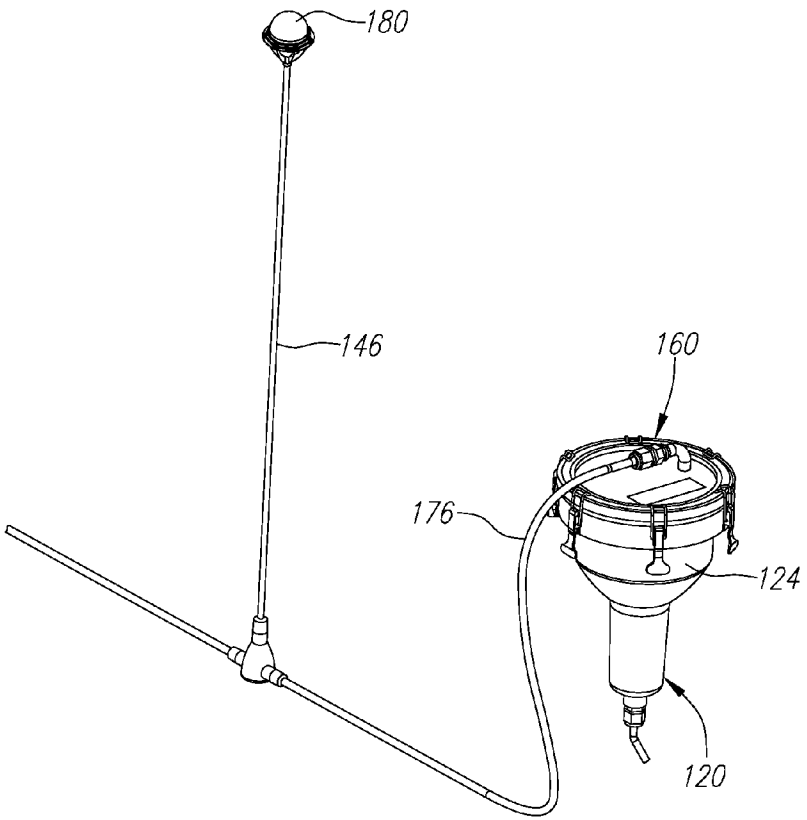
FIG. 5B is a perspective view of lighting equipment for the display showing the power supply plugged into the outlet.
Figure 5A:
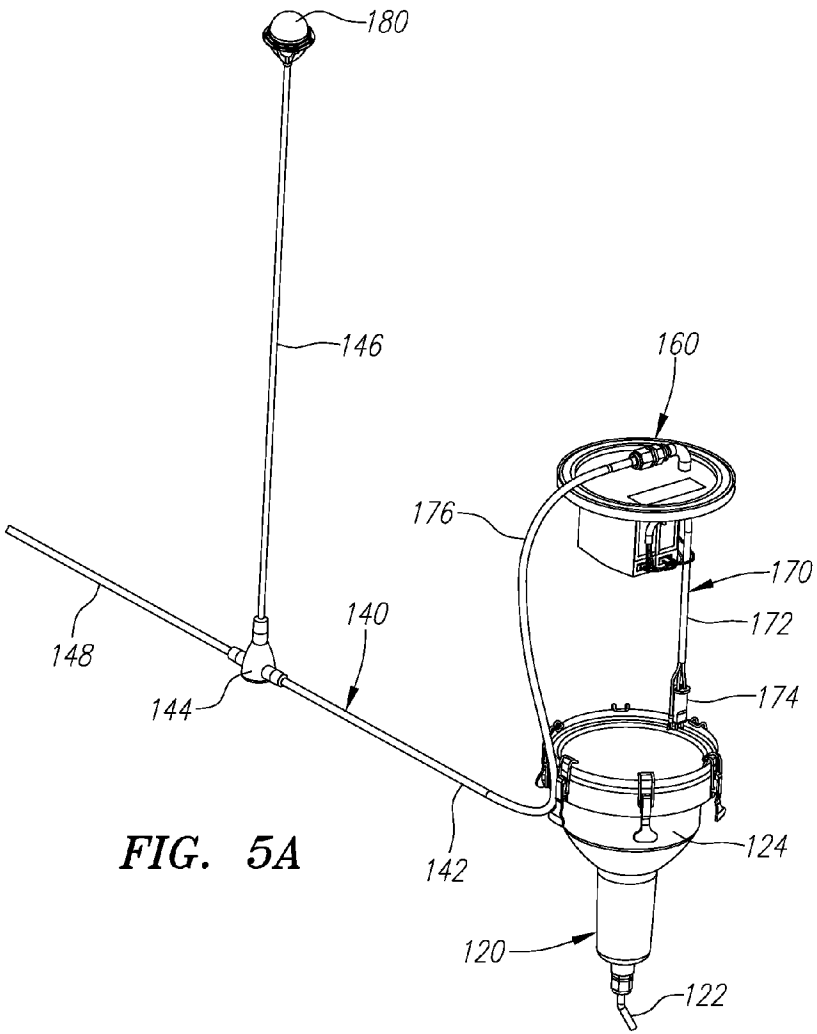
FIG. 5A is a perspective view of lighting equipment for the display showing a power supply separate from an outlet.
Figures 6, 7:
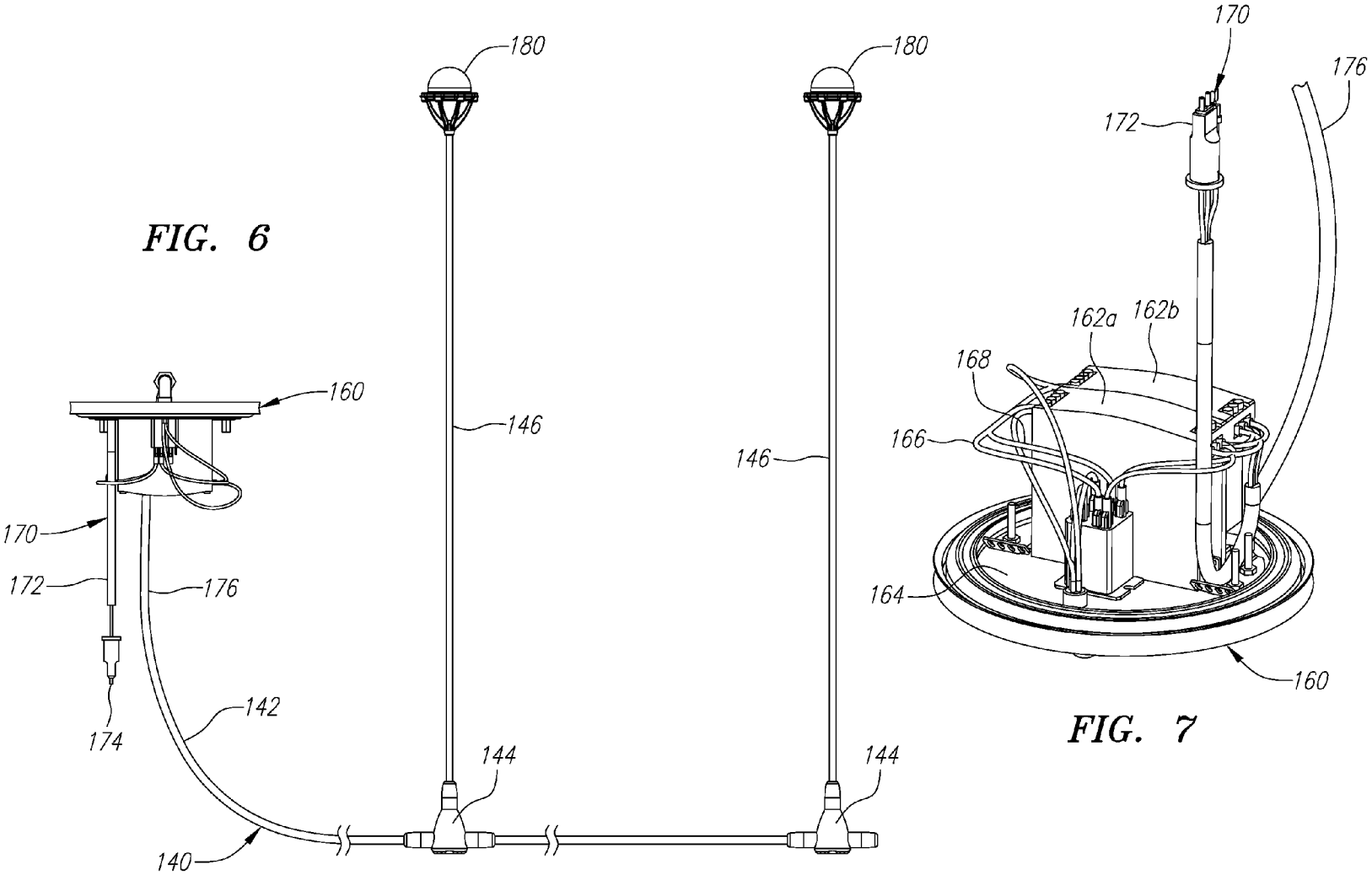
FIG. 6 is a side view of lighting equipment for the display.
FIG. 7 is a perspective view of a power supply turned upside down.

Power supply 160 and the manner in which it plugs into outlet 120 are now described in more detail with reference to FIGS. 5A, 5B, 6 and 7. FIG. 5A shows power supply 160 before it is plugged into outlet 120, while FIG. 5B shows power supply 160 plugged in. FIG. 6 shows power supply 160 connected to string 140 and two lights 180, and also prior to it being plugged into an outlet 120 (not shown in FIG. 6). FIG. 7 shows power supply 160 upside down to provide more detail.

As best shown in FIG. 7, which shows power supply 160 turned upside down from how it would generally exist in display 10, power supply 160 may include two power supplies 162*a*, 162*b* that provide 12 v DC power to lights 180. Power supply 160 thus converts incoming 120 v AC power to outgoing 12 v DC power. Power supplies 162*a*, 162*b* may be mounted to plate 164. Plate 164 may be made of copper which is preferable since it is a good conductor of heat. Plate 164 may thus transfer the heat that may be created by power supplies 162*a*, 162*b* to the surrounding water to avoid overheating of the power supplies.

Other components may be mounted to plate 164 such as relay 166 and relay 168. Electrically, relays 166, 168 are located between power supplies 162*a*, 162*b* and a microcontroller 194 in lights 180. As discussed in more detail later, relays 166, 168 may function so that when the power is cycled to set the mode of the flashing of lights 180, microcontroller 194 may see a sudden dead-off instead of a ramp down in power that may otherwise occurs when power supplies 162*a*, 162*b* are shut off.

Power supply 160 may also include input power line 170 that may include cable 172 and plug 174. Plug 174 may be plugged into the outlet 120 to provide power to power supplies 162*a*, 162*b*. Power supply 160 may also include output power line 176 that extends from power supply 160 to provide power to lights 180. As shown in FIG. 6, power line 176 may form a part of string 140 en route to lights 180.

Power supply 160 may be plugged into outlet 120 as shown in FIG. 5B. In this manner, the volume of power supplies 162*a*, 162*b* and any other components mounted to plate 164 preferably fit into the volume of outlet 120. To this end, outlet 120 may include housing 124 to receive power supply 160. Plate 164 may attach to outlet housing 124 by a gasket and latches in similar fashion to how the lens for the light which had previously been plugged into outlet 120, had been. This is an advantage of the current invention in that outlet 120 may now serve a new purpose of functioning as the power supply for power supply 160, where it had previously acted as an outlet for a light itself. And this may occur without any extensive change in existing lighting equipment. Plate 164 may be attached to outlet 120 in other manners as well, but in any event, it is preferred that this attachment be water resistant.

Strings 140 and their component cable parts 142, 146, 148, 176 may be flexible. Strings 140 may comprise a rubber or other water resistant material which may house power lines providing power to lights 180. The flexibility of strings 140 allows randomness in the placement of lights 180 in pool 20. Strings 140 may also include some number of T-junctions depending on the number of lights 180 to be connected to a particular string 140. There may be more T-junctions 144 on a particular string 140 than lights 180. In this manner, the top connection 146 of T-junction 144 may be closed off. However, a light 180 may be later installed to that T-junction 144. This provides flexibility in the overall design of lighting 100.

Figure 8:
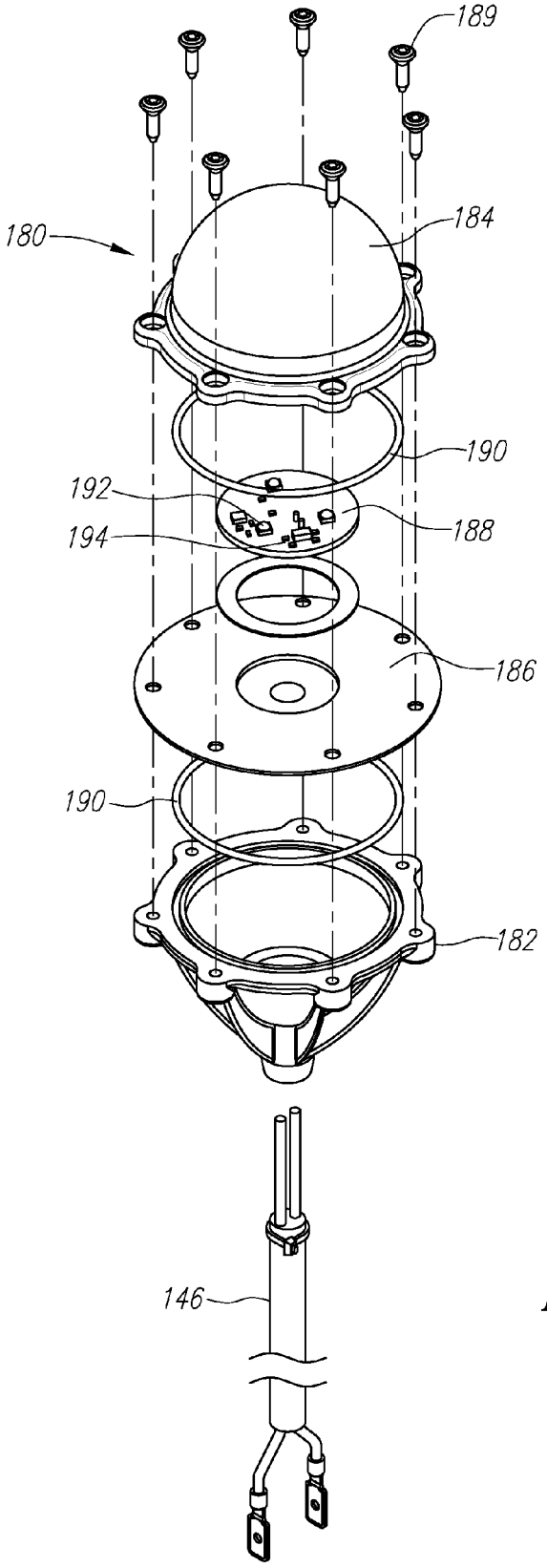
FIG. 8 is an exploded view of a lighting assembly.
Figure 9:
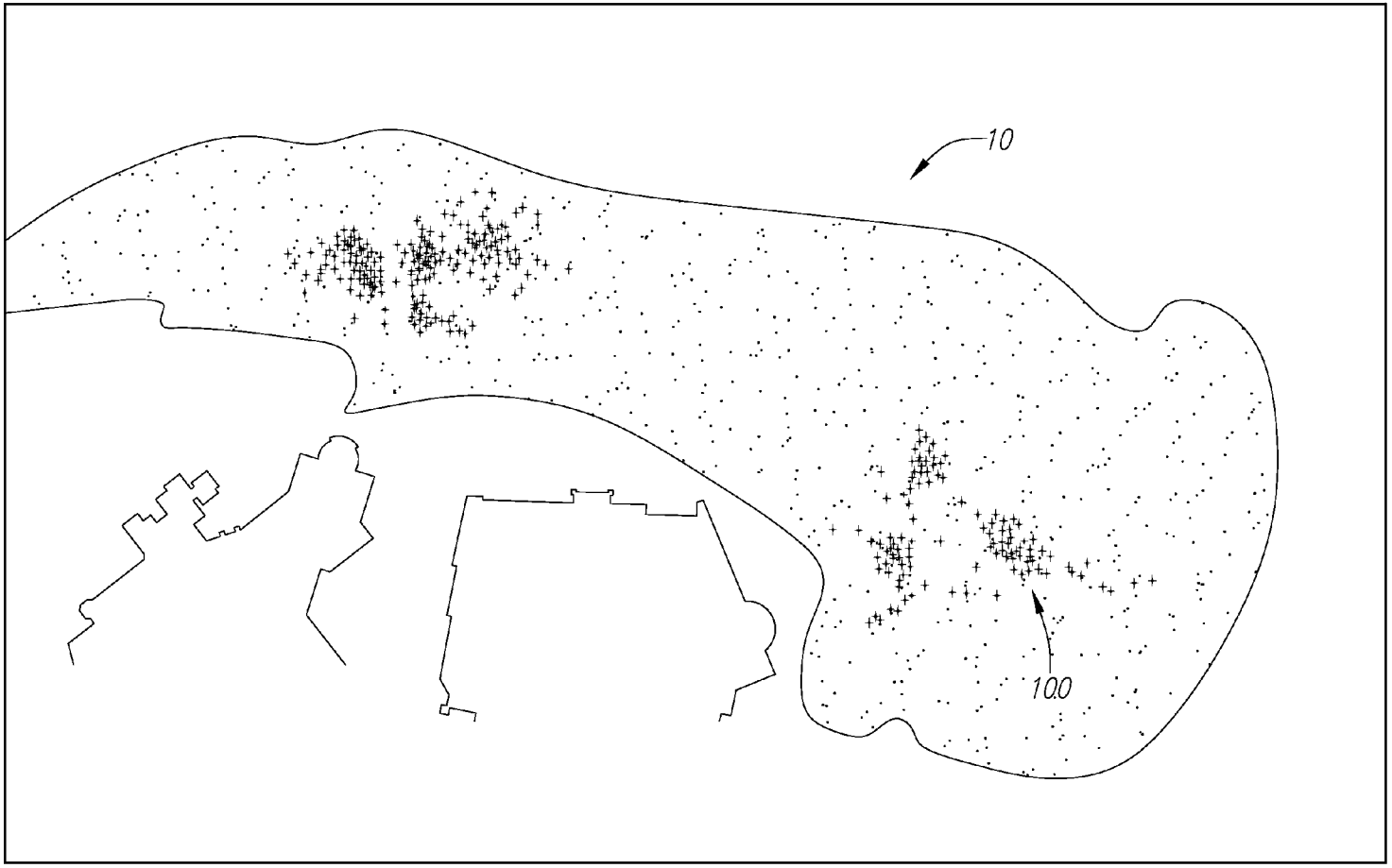
FIGS. 9-12 are perspective views of the display of the current invention that show how the lights in the display may be turned on and off at different times.
Figure 10:
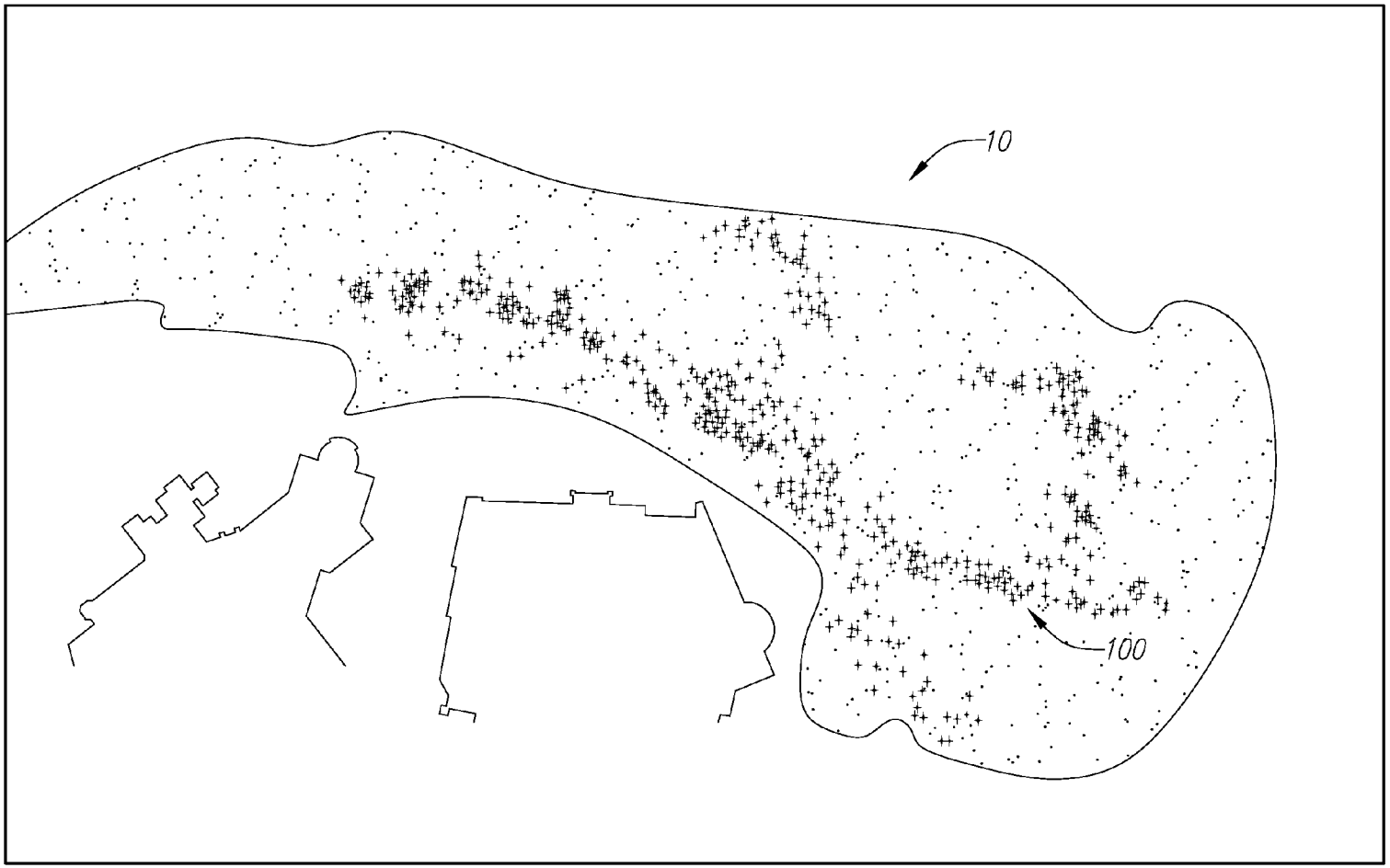
Figure 11:
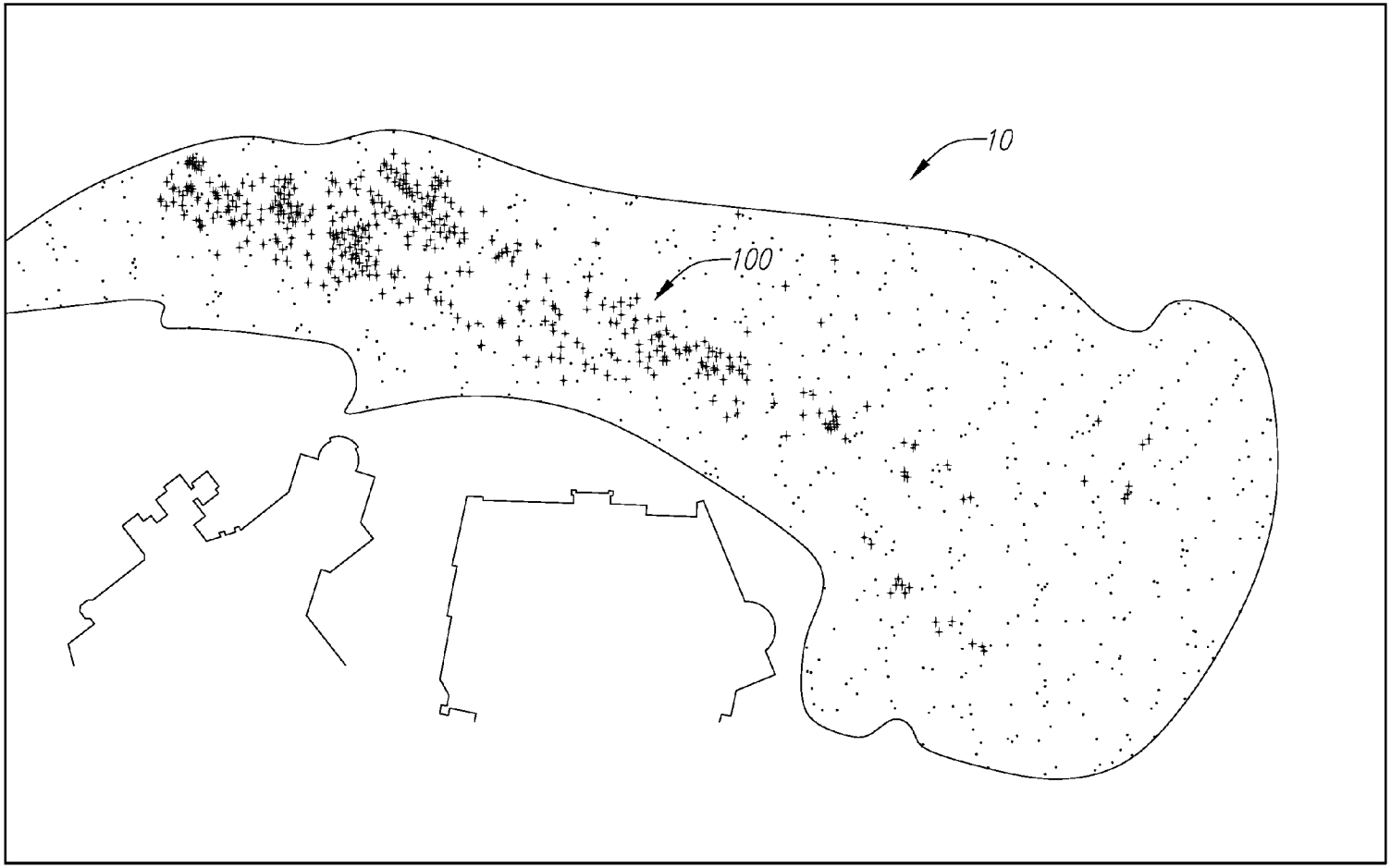
Figure 12:
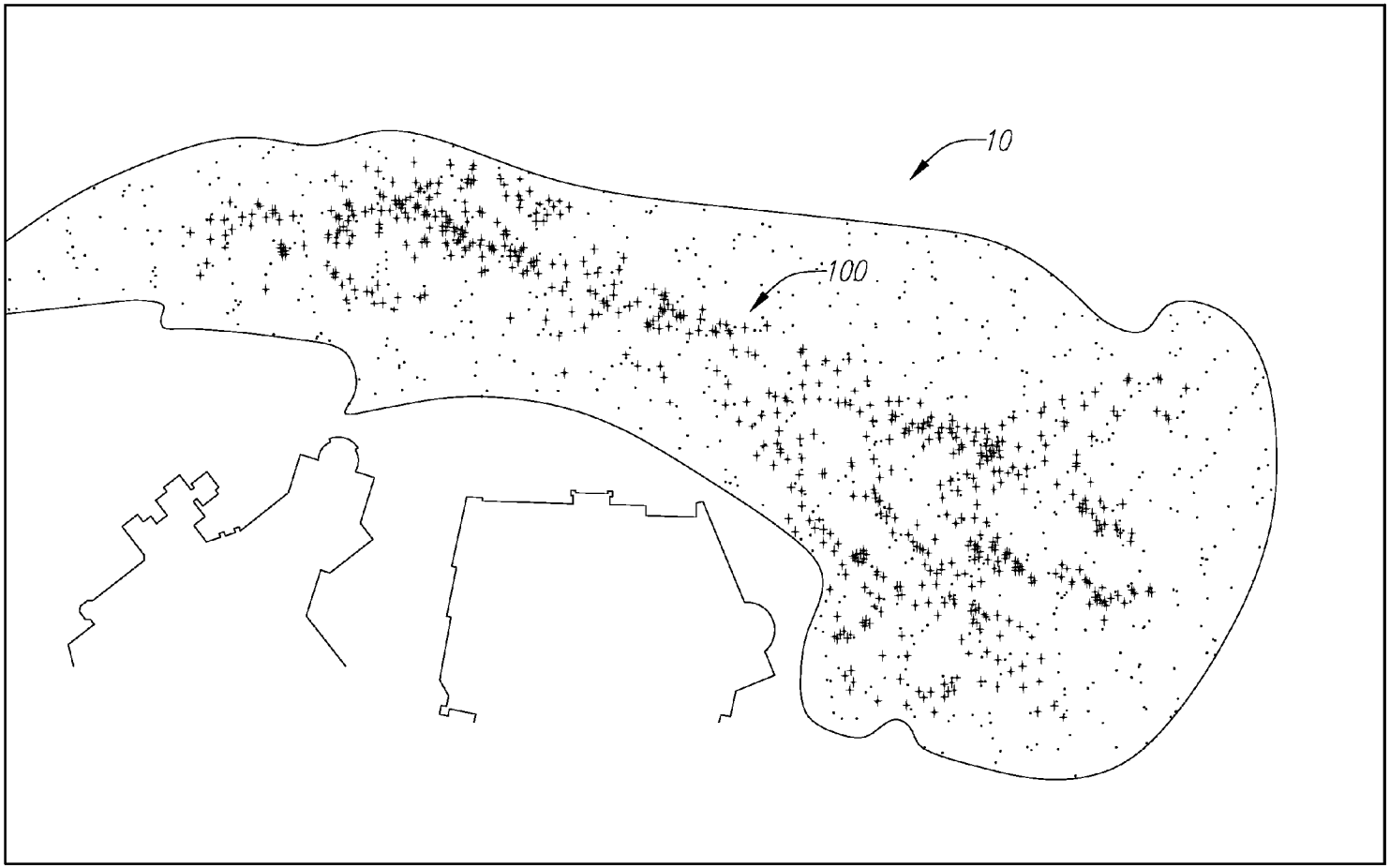

Lights 180 are now discussed in more detail with reference to FIG. 8. As mentioned above, power line 176 may extend to T-junction 144, and from there, cable 146 may extend to light 180. Cable 146 may plug into light housing 182. Light 180 may include additional components between housing 182 and dome 184. These may include heat sink 186, PCB 188, O-rings 190 and other components. As indicated above, it is preferred that air is trapped within dome 184 to contribute buoyancy. In any event, dome 184 may be attached to housing 182 through screws 189 or other suitable attachment means.

PCB 188 may include one or more LEDs 192, microcontroller 194 and other components. Heat sink 186 preferably dissipates the heat created by LEDs 192 or other light source that may be used. To this end, heat sink may comprise a material which is a good thermal conductor.

As discussed in more detail below, an aspect of the current invention relates to the randomness with which lights 180 may blink. This may be controlled by software embedded on microcontroller 194. This software may dictate that lights 180 operate in a particular mode, and the mode selected may in turn be controlled by a number of power cycles experienced by microcontroller 194.

Accordingly, part of the control over lights 180 relates to the power being turned on and off, i.e., cycled, a desired number of times to set the mode which in turn controls lights 180 to flash according to that particular mode. As mentioned above, the relays 166, 168 provide a sudden dead off in power to microcontroller 194 instead of a ramp down in power that may otherwise occur when power supply 160 is shut off. In other words, the output of power supply 160 is delivered to the microcontroller through the mechanical switch of relays 166, 168.

When the power is turned off (and then back on) to change the light flashing mode, the switch on relays 166, 168 opens and provides a sudden, sharp off to microcontroller 194. If the power to microcontroller 194 came straight from power supply 160 without relays 166, 168, microcontroller 194 would instead experience a slow fade away of power which would not cause it to change modes. But with the sudden, sharp off, perceptible power cycles may be experienced by microcontroller 194 which allows the flashing mode to be changed.

Another aspect of the current invention regarding the random nature in which lights 180 may flash is now described. Generally, software may be used to provide that lights 180 randomly flash. The software may provide a number of modes so that the manner in which lights 180 flash may be changed. As noted above, the mode to be used may be determined by the number of power cycles experienced by microcontroller 194 on which the software may be embedded. This represents an advance by the current invention because the relatively easy task of powering the power supplies 160 off and on may effect a change in the mode of how the lights 180 flash.

As noted above, each light 180 may include a PCB 192 having a microcontroller 194 with embedded software, LEDs 192, LED drivers and other suitable components. The software provides a unique method of randomly blinking the lights.

The microcontroller 194 for each light 180 may be loaded with the software along with a random serial number that may be obtained from existing random number tables or generated in other ways that will provide reasonable uniqueness of the serial number within the set of lights 180 used in display 10. The randomly assigned serial number is then used by the software to initialize a random number generator which is used to produce random numbers. These random numbers are used to calculate the initial delay in the first flash of light 180, as well as the consecutive delays between subsequent flashes.

The random nature of the initial delay provides that individual lights 180 will start blinking at different times. Furthermore, the random numbers used to generate each consecutive delay between subsequent flashes ensure that the flashing of the lights is not predictable.

The software embedded on microcontroller 194 may generally include a control part and a show part regarding the manner in which the lights flash. The control part may refer to light set-up, while the show part may refer to the portion of time when the light show is actually occurring and lights 180 are flashing.

During the control part, which starts when the power is applied from power supply 160 to the lights 180 on a particular string 140, the LED driver is disabled, and so LEDs 192 do not emit any light. The embedded software increments the value of a mode counter that may be stored in the non-volatile memory that may or may not be a part of the microcontroller 194, and waits for a predetermined amount of time. After the fixed delay the embedded software also waits for another time period, which length is random and also depends on the mode. In this manner, if during the control part, power is switched off and then switched on again, the mode counter increases and the mode is changed.

During the show part, the mode remains the same as it was determined from the mode counter during the control part but the mode counter itself is reset to 0. In this manner, if the light is powered off during the show part, at the next power on event, it will reset itself to the first mode.

Light 180 is dark during the control part because the LED driver is disabled as noted above. But during the show part, light 180 randomly blinks in the following manner: the embedded software enables the LED driver and provides a control signal to the driver to turn LEDs 192 on or off. LEDs 192 may stay on for a predetermined amount of time thus producing a flash of light. Typical time-on is on the order of 10-100 ms depending on the desired light expression. LEDs 192 may stay off for a period of time that is calculated after each flash, using the mode value and a random number obtained from a random number generator algorithm implemented in the embedded software. The mode value determines the maximum possible delay between flashes; the actual delays are equally distributed between 100 ms and a maximum. Hence, the higher the mode the longer time between flashes on average, though rapid succession of two or more flashes is still possible.

Below is a representing of the time between flashes in seconds according to sample modes. It should be noted that these modes and time periods are examples only and do not limit the scope of the invention.

| | Time between flashes in seconds | | |
|---|---|---|---|
| Mode | Minimal | Typical | Maximum |
| 1 | 0.1 | 0.2 | 0.4 |
| 2 | 0.1 | 0.6 | 1.1 |
| 3 | 0.1 | 1.2 | 2.4 |
| 4 | 0.1 | 2.1 | 4.2 |
| 5 | 0.1 | 3.3 | 6.5 |
| 6 | 0.1 | 4.7 | 9.3 |
| 7 | 0.1 | 6.3 | 12.6 |
| 8 | 0.1 | 8.2 | 16.4 |
| 9 | 0.1 | 10.4 | 20.8 |
| 10 | 0.1 | 12.8 | 25.6 |

The typical time between flashes may be determined by:

$$T_{average}=(\text{Mode}^2+2)\times 0.127+0.1$$

The maximum time between flashes may be determined by:

$$T_{max}=(\text{Mode}^2+2)\times 0.255+0.1$$

The suggested approach provides for controlling the light (i.e. changing modes) without additional control circuitry because switching power on and off (power cycling) during the control part of the light operation will effect mode changes. This is useful for installations where other means for communication with the lights (i.e. dedicated control circuit, communication over power line, wireless etc.) are not available.

Several advantages of the software of the current invention are now further described. Programming a number of lights to randomly flash would become more complex as the number of lights increases. However, with each light 180 of display 10 having an embedded microcontroller 194, each light may be programmed by simply turning on and off power supply 160 at the beginning to change modes. Furthermore, programming and control over the flashing of lights 180 may be achieved because lights 180 are ultimately plugged (via power supplies 160) into existing sockets 120, and the power to sockets 120 may be controlled by a program that may allow entire strings 140 to turn on or off according the program running the power to outlets 120. And as noted above, the programs in the LED microcontrollers 194 may be changed by rapidly cycling the power to them.

FIGS. 9-12 show perspective views of display 10 with a focus on lights 100 of strings 140. In these figures, other features of display 10, such as water shooters and the like, are not shown. As can be seen from FIGS. 9-12, the lights 100 in different portions of display 10 may be turned on at different times, thereby reflecting the random nature of the overall visual effect of display 10.

The current invention may also randomly affect other characteristics of display 10 beyond randomly turning lights 100 on and off. For example, lights 180 may include multiple LED sets with different optics on them in each light 180 or some number of lights 180. In this aspect of the invention, mode changes may relate to selecting between different optics instead of, or in addition to, relating to the manner in which lights 180 may flash. For example, this type of mode control may apply to RGBW LEDs, where modes may change between primary colors and/or blending of colors. As another example, modes may be used to select randomly on the same string 140 between two or more effects, such as a blue and white flash, or a double flash and a shorter single flash. In this manner, a large field of lights 100 may appear as individually programmed, but may not be in reality.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A lighting display, comprising:

a plurality of outlets which provide power;

a plurality of power supplies that are electrically coupled to the plurality of outlets; and a plurality of lights, wherein the lights extend from corresponding power supplies;

wherein each light includes electronics that cause a random flashing of each light.

2. The lighting display of claim 1, wherein the electronics include a microcontroller embedded with software that controls the random flashing of the light.

3. The lighting display of claim 1, wherein the random flashing of the lights is controlled by pulsing the power to the lights, and the electronics included in each light selects different frequencies of random flashing depending on the number of pulses of power within a time period.

4. The lighting display of claim 1, wherein different lights are configured to be turned off or on independently.

5. The lighting display of claim 1, further comprising a plurality of strings that each extend from corresponding power supplies, wherein each string includes a number of lights.

6. The lighting display of claim 5, wherein different strings of lights are configured to be turned off or on independently.

7. The lighting display of claim 1, wherein each light operates in one or more modes, wherein the mode determines the frequency range at which the light flashes.

8. The lighting display of claim 7, wherein the mode is changed by turning the power to the light off and then back on.

9. The lighting display of claim 7, wherein the mode determines the maximum possible length of delay between flashes.

10. The lighting display of claim 7, wherein each mode has an associated minimal time between flashes, typical time between flashes and maximum time between flashes.

11. The lighting display of claim 1, wherein the electronics include a microcontroller embedded with software that controls the random flashing of the light;

wherein the software selects a mode of operation based on a cycling of power to the light; and wherein the random flashing of the light is controlled by the selected mode.

12. The lighting display of claim 11, wherein the software calculates an initial delay in the first flash of the light and consecutive delays between subsequent flashes of the light.

13. A lighting display, comprising:

a plurality of outlets which provide power;

a plurality of power supplies that are electrically coupled to the plurality of outlets; and a plurality of strings each including a number of lights that are submerged under water, wherein the strings extend from corresponding power supplies;

wherein each light includes electronics embedded with software that controls the random flashing of the lights.

14. The lighting display of claim 13, wherein the lights include a housing and a dome.

15. The lighting display of claim 13, wherein air is trapped in the housing so that the lights are buoyant.

16. The lighting display of claim 13, wherein the power supply includes relays that provide a sudden dead off of power to the strings of lights during a power cycling period.

17. The lighting display of claim 13, further comprising a water fountain.

* * * * *